US005768086A

United States Patent [19]

Abe

[11] Patent Number: 5,768,086

[45] Date of Patent: Jun. 16, 1998

[54] STATIC VOLTAGE DISSIPATION DEVICE

[76] Inventor: Michio Abe, 210 Easy St., No. 21, Mountain View, Calif. 94043

[21] Appl. No.: 729,186

[22] Filed: Oct. 11, 1996

[51] Int. Cl.[6] ..... H05F 3/00

[52] U.S. Cl. ..... 361/212; 361/220

[58] Field of Search ..... 361/212, 213, 361/220, 222, 56, 58, 91; 340/635, 649, 654, 659, 660

[56] References Cited

U.S. PATENT DOCUMENTS

| | | | |
|---|---|---|---|
| 3,745,412 | 7/1973 | Ruff | 317/2 |
| 4,104,695 | 8/1978 | Hollis et al. | 361/220 |
| 4,475,141 | 10/1984 | Antonevich | 361/220 |
| 4,570,200 | 2/1986 | Osada et al. | 361/212 |
| 4,619,275 | 10/1986 | Ross et al. | 128/783 |
| 4,852,374 | 8/1989 | Gotanda | 70/456 |
| 4,862,315 | 8/1989 | Cubbison, Jr. | 361/212 |
| 4,885,728 | 12/1989 | Gosselin | 368/10 |
| 5,222,013 | 6/1993 | Schwalm | 361/212 |

*Primary Examiner*—Jeffrey A. Gaffin
*Assistant Examiner*—Michael J. Sherry
*Attorney, Agent, or Firm*—Jeffrey P. Aiello; Aiello Patent Prosecution

[57] ABSTRACT

A portable static voltage dissipation device configured to be transported on a users person is provided. The device of the present invention includes a hollow, preferably impact resistant, translucent housing. The housing is impact resistant to prevent damage from coming to electronic devices retained therein. Electrically conductive end caps are coupled to first and second ends of the housing. The end caps provide a grasping location for the user. A resistor to prevent excessive current from flowing from the user to inhibit the user from receiving an electrical shock, is coupled to an end cap and an electrostatic voltage discharge indicating device is connected to the resistor and the remaining end cap. The indicating device provides a visual indication that a charge of electrostatic voltage accumulated in the body of the user has been discharged by the device. A translucent, non-electrically conductive material is disposed in the housing to prevent the end caps, resistor, and the indicating device from inadvertently short circuiting while providing viewing of electrostatic voltage discharged by the indicating device. In use, the user grasps a desired one of the end caps and with the remaining end cap abutting an electrically conductive object to ground the device. Electrostatic charge accumulated in the user is dissipated through the device, with the resistor controlling current flow, to prevent the user from receiving an electrical shock.

13 Claims, 2 Drawing Sheets

STATIC VOLTAGE DISSIPATION DEVICE

BACKGROUND OF THE INVENTION

1. Field of the Invention

The present invention relates generally to static voltage discharge devices, and more particularly, to an improved portable static voltage dissipation device.

2. Description of Related Art

It is well known that under certain conditions the human body is capable of accumulating a substantial electrostatic charge, sometimes ranging from approximately 15,000 to 25,000 volts. The discharge of such an electrostatic charge typically results in an unpleasant and often painful shock. Conditions that are conducive to electrostatic charge buildup are when the air has substantially low humidity, as when it is windy or during the winter months, and persons are moving about indoors, such as walking on rugs and moving across fabric, typically upholstered furniture.

Once there is an electrostatic charge buildup on a persons body, contacting or being in close proximity to an electrical conductor, results in the rapid discharge of the electrostatic energy. Typical electrical conductors include door knobs, television knobs, most metal objects, and other persons, for example. The rapid discharge of the electrostatic energy causes a large current flow from the person to the conductor, resulting in the potentially painful shock to the person.

A number of devices in the prior art have attempted to alleviate the current flow between the person and conductor. One such device is disclosed in U.S. Pat. No. 5,222,013, to Schwalm, which is directed to an electrostatic discharge device the is secured over the cover of a wall mounted switch. The discharge device purportedly provides a readily available instrument for discharging an electrostatic charge developed on the body of a person. The electrical circuit includes a grounded conductor, a current limiting resistor, an electrical discharge component, a lamp, and an electrode for receiving a current flow to discharge an electrostatic charge. However, a disadvantage of the device disclosed therein, is that it is not portable. Thus, potentially several devices may be necessitated at a single installation location, such as wherever a user may contact an electrical conductor, for the device to be effective. This could become somewhat costly to the user.

U.S. Pat. No. 3,745,412, to Ruff, discloses an electrostatic discharge device that enables the user to dissipate an electrostatic charge, such as picked up from walking on a rug. The disclosed device comprises a ring that is worn on the user's finger and includes an indicator lamp, which provides a visual indication of the charge dissipation.

U.S. Pat. No. 4,104,695, to Hollis et al. is directed to a static electricity discharge ring that comprises an adjustable metal band abutting the human body. One end of a gaseous discharge tube is connected to the band and the other end of the tube is connected to an elliptically-shaped electrode. A human being having built up a charge of static electricity, can discharge the static electricity build up through the neon discharge tube to ground. A disadvantage of the disclosed ring, along with the device by Ruff, it that it must be personally worn by the user to function as anticipated. Thus, if the user forgets to place the ring on their finger, they are susceptible to shocks.

U.S. Pat. No. 4,852,374, to Gotanda, discloses an electrical shock-preventable key unit. The disclosed unit includes a case slidably accommodating a key body, a slide plate, and an electrical shock preventing system. The shock preventing system comprises a conductive member provided on the case, a resistor for gradually discharging static electricity, and a conductive piece that contacts with the key body.

Although the devices disclosed in the above enumerated prior art references have improved features, they fail to disclosed all of the advantageous features achieved by the present invention.

OBJECTS OF THE INVENTION

It is therefore an object of the present invention to provide an improved portable static voltage dissipation device;

It is another object of the present invention to provide an improved portable static voltage dissipation device that does not have to be worn by the user;

It is another object of the present invention to provide an improved portable static voltage dissipation device that indicates discharge of electrostatic energy; and It is a further object of the present invention to provide an improved portable static voltage dissipation device that will function in the presence of moisture.

SUMMARY OF THE INVENTION

These and other objects and advantages of the present invention are achieved by providing an improved portable static voltage dissipation device. The dissipation device of the present invention is preferably configured to be transported on a users person, such as in a pocket of their clothing or in a purse, for example. The device of the present invention includes a hollow, translucent housing. The housing is preferably pliant to resist impacts to the housing for preventing damage from coming to electronic devices retained therein.

An electrically conductive end cap is coupled to each end of the housing. The end caps provide a grasping location for the user. Additionally, in the preferred embodiment, the end caps, along with the housing, are annular in cross-sectional configuration, to enhance grasping of the end caps and device.

A resistor is provided in the housing to prevent excessive current from flowing from the user and through the device, to prevent the user from receiving an electrical shock. In the invented dissipation device, the resistor has a terminal coupled to one end cap and another terminal coupled to an electrostatic voltage discharge indicating means. The indicating means has its first terminal connected to the resistor and its remaining terminal connected to the remaining end cap. In the preferred embodiment, the indicating means provides a visual indication to the user, that a charge of electrostatic voltage accumulated their body has been discharged by the device. The indicating means may comprise a glow tube, such as a neon or argon gas glow tube.

Additionally, a translucent, non-electrically conductive or insulating material may be disposed in the housing. The insulating material prevents the end caps, resistor, and voltage discharge indicating means from inadvertently short circuiting, while providing viewing of electrostatic voltage discharged by the indicating means.

In use, the user grasps a desired one of the end caps and with the remaining end cap abutting an electrically conductive object, such as a metallic door knob, to ground the device. Electrostatic charge accumulated in the user is dissipated through the device, with the resistor controlling current flow, to prevent the user from receiving an electrical shock.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes presently contemplated by the inventor of carrying out his invention. Various modifications, however, will remain readily apparent to those skilled in the art, since the generic principles of the present invention have been defined herein.

Figure 1:
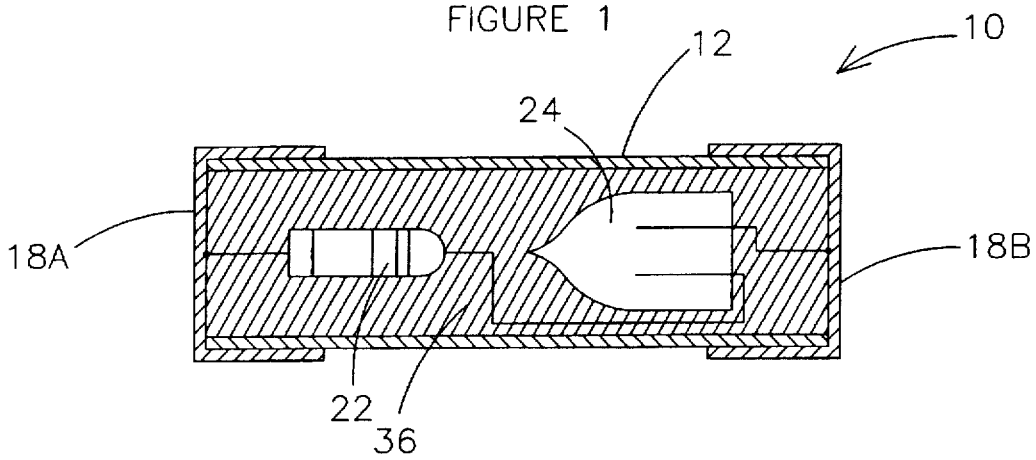
FIG. 1 is a cross-sectional view showing a preferred embodiment of a portable static voltage dissipation, device of the present invention.
Figure 2A:
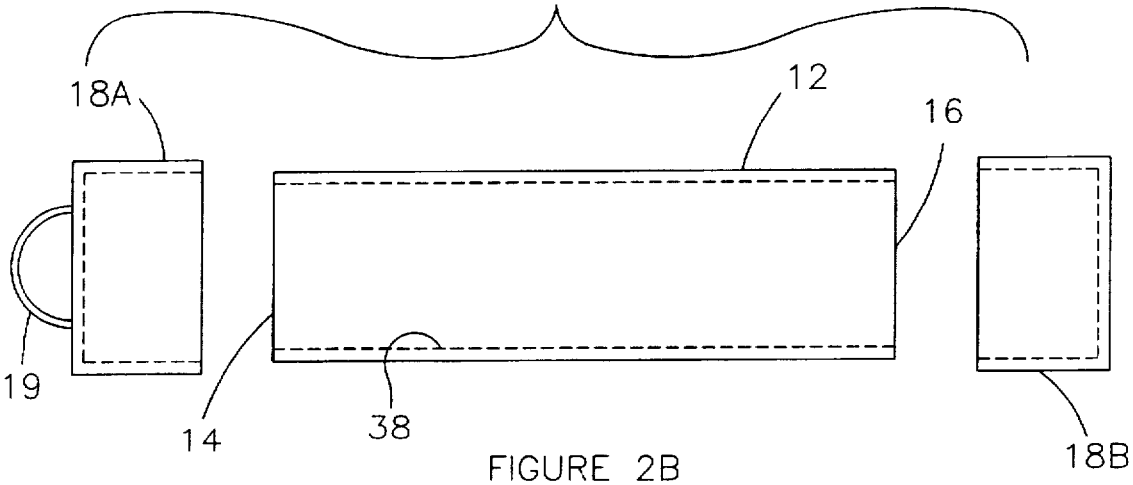
FIG. 2A is an exploded view showing the preferred embodiment of the device of the present invention.
Figure 2B:
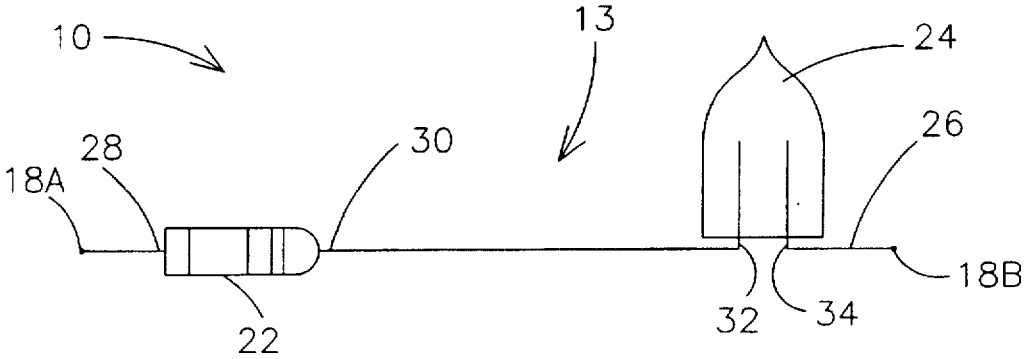
FIG. 2B is schematic view showing electronic circuitry of the present invention.

Referring now to FIG. 1 and FIGS. 2A and 2B of the drawings, there is shown generally at 10, a portable static voltage dissipation device constructed according to the principles of a preferred embodiment of the present invention. The device 10 is configured to be transported on a users person. Thus, the device 10 preferably ranges from approximately 3.5 to 7 centimeters long and approximately 0.5 to 1.5 centimeters in diameter. In the preferred embodiment, the device 10 comprises a hollow, pliant, translucent, cylindrical housing 12 having a first end 14 and a second end 16. The housing 12 preferably comprises a somewhat pliant, substantially impact resistant material to prevent damage from coming to electronic circuitry 13 retained therein, such as a known translucent polymer.

A first conductive end cap 18A is disposed over the periphery of the first end 14 of the housing 12 and is frictionally engaged thereby and a second electrically conductive end cap 18B is disposed over the periphery of the second end 16 of the housing 12 and frictionally engaged thereby, thus securing the end caps 18 to the housing 12. The end caps 18 have approximately the same diameter as the periphery of the housing 12, so that the pliability of the housing frictionally engages the end caps 18, and to enhance grasping of the device 10 by the user.

Optionally, an annular member 19 may be affixed to one of the end caps 18A. The annular member 19 would be provided for securing the invented device 10 to a user's key ring, for example.

The electronic circuitry, shown generally at 13 in FIG. 2B, of the portable static voltage dissipation device 10 of the present invention comprises a resistor 22 and an electrostatic voltage discharge indicating means 24. The resistor 22 is provided for controlling current flow through the device 10, and thus preventing excessive current flow through the user, so that the user does not receive an electrical shock. In the preferred embodiment, the resistor 22 has a resistance value ranging from approximately one megohm to approximately three megohms. However, the resistor 22 may be any appropriate value, depending upon such factors as the electrically conductive material comprising the end caps 18 or the gauge of wire 26 coupling the resistor 22 to the indicating means 24, for example.

The resistor 22 has a first terminal 28 coupled to the first end cap 18A and a second terminal 30 connected to a terminal 32 of the discharge indicating means 24. The indicating means 24 has another terminal 34 coupled to the remaining end cap 18B. Preferably, the electrostatic voltage discharge indicating means 24 provides visual indication that a charge of electrostatic voltage accumulated in the body of the user, has been discharged by the device 10. In the preferred embodiment, the indicating means 24 comprises a well known glow tube having a low dielectric strength gas disposed therein, such as neon or argon gas.

Referring again to FIG. 1 of the drawings, a translucent, non-electrically conductive or insulating, pliant, material 36 is disposed in the housing 12 to prevent the end caps 18, resistor 22, and indicating means 24 from inadvertently short circuiting or contacting an inner surface 38 (shown in FIG. 2) of the housing 12. The insulating material 36 is preferably translucent to provide viewing of electrostatic voltage discharged by the indicating means 24. The material 36 may comprise any non-electrically conductive material known in the art, such as a number of polymeric materials. The insulating material 36 prevents the resistor 22 and indicating means 24 from short circuiting, due to such factors as wetness, since the material 36 provides a barrier around the circuitry 13 and between the components thereof.

Figure 3:
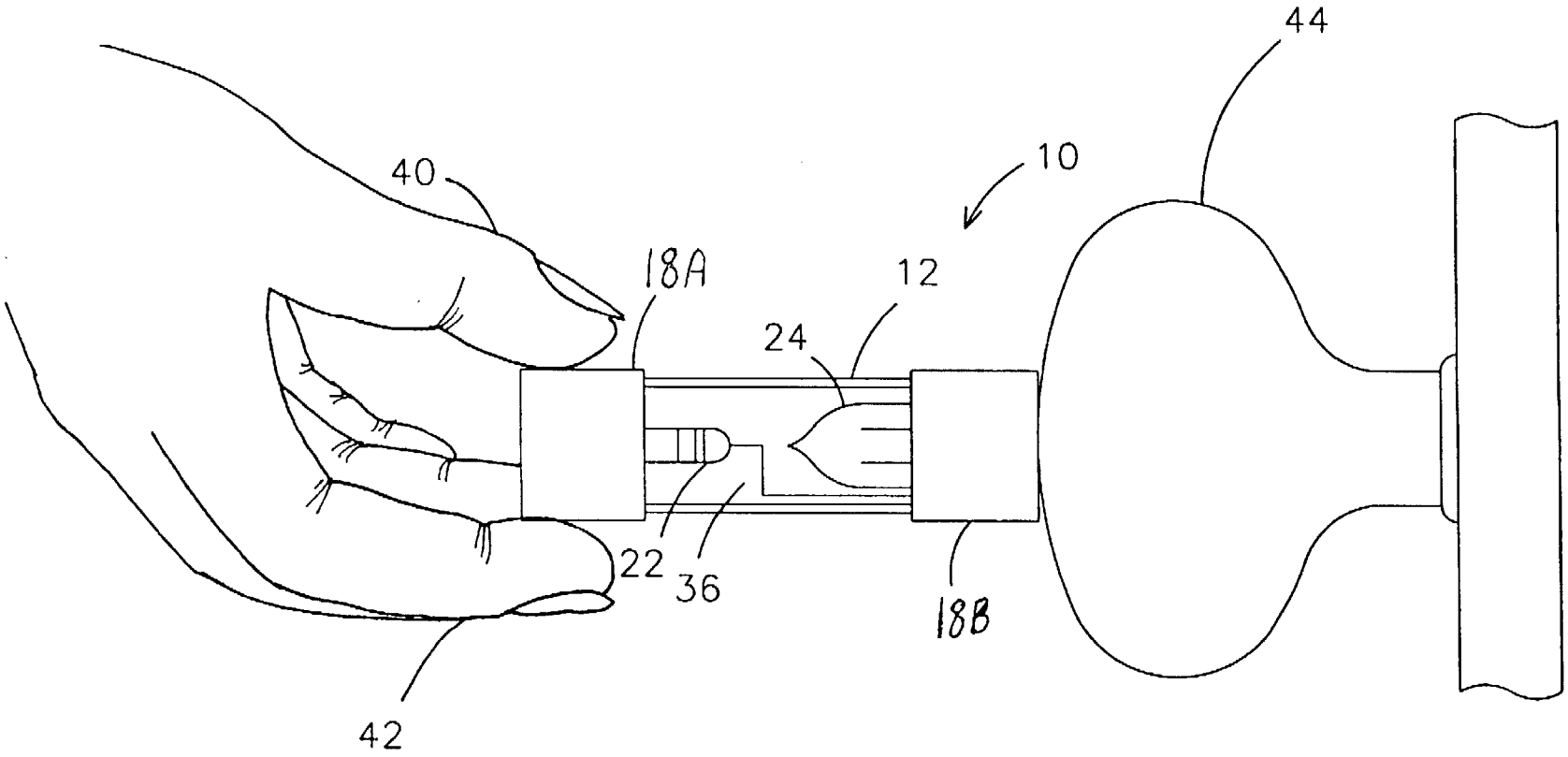
FIG. 3 is a perspective view showing the preferred embodiment of the static voltage dissipation device of the present invention in use.

Referring now to FIG. 3 of the drawings, in use, the user grasps one of the end caps 18A of the device 10 with their thumb 40 and forefinger 42, for example. With the remaining end cap 18B, the user abuts an electrically conductive object, such as a door knob 44, to ground the device 10. Upon the end cap 18B contacting the door knob 44, electrostatic charge accumulated in the user is dissipated through the device 10. The resistor 22 controls current flow from the user through the device 10 to prevent the user from receiving an electrical shock when touching the door knob 44, while the indicating means 24 is illuminated to indicate to the user that electrostatic charge accumulated in the user has been dissipated through the device 10. The user can then touch the knob 33, without fear of receiving a shock.

Thus, there has been described an improved portable static voltage dissipation device that is configured to be transported on the users person. The housing is impact resistant to prevent damage from coming to electronic devices retained therein, and translucent for viewing voltage discharged by the device, as indicated by the indicating means. The resistor prevents excessive current from flowing from the user, for inhibiting the user from receiving an electrical shock. The insulating material prevents the circuitry from inadvertently short circuiting, while providing viewing of electrostatic voltage discharged by the indicating device.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A portable static voltage dissipation device, the device configured to be transported on a users person, the device comprising:

a hollow, flexible, translucent housing having a first end and a second end;

a first electrically conductive end cap coupled to the first end of the housing and a second electrically conductive end cap coupled to the second end of the housing, the end caps configured to enhance grasping of the device by the user;

a resistor retained in the housing and having a first terminal coupled to the first end cap for receiving current therefrom indicative of an accumulated electrostatic charge in the user and a second terminal;

electrostatic voltage discharge indicating means for providing visual indication that a charge of electrostatic voltage accumulated in the body of the user has been discharged by the device, the indicating means having a first terminal coupled to the resistor for receiving current therefrom for activating the indicating means and a second terminal coupled to the second end cap of the housing; and electrical insulating means disposed in the housing to prevent the end caps, resistor, and voltage discharge indicating means from inadvertently short circuiting while providing viewing of electrostatic voltages discharged by the indicating means, wherein accumulated electrostatic charge in the user is dissipated when the user grasps one of the end caps and abuts the remaining end cap against an electrically conductive object to ground the device, electrostatic charge accumulated in the user being dissipated through the device to prevent the user from receiving an electrical shock.

2. The device of claim 1 wherein the resistor has a resistance value selected to provide sufficient resistance to current flowing through the device to prevent excessive current from flowing from the user to the device for inhibiting the user from receiving an electrical shock.

3. The device of claim 1 wherein the electrostatic voltage discharge indicating means comprises a glow tube having a gas disposed therein of a low dielectric strength.

4. The device of claim 3 wherein the gas is selected from the group consisting of neon and argon.

5. The device of claim 1 wherein the insulating means comprises a non-conductive pliant material.

6. A portable static voltage dissipation device, the device configured to be transported on a users person, the device comprising:

a hollow, pliant, elongated, translucent housing having a first end and a second end, the pliant housing being substantially impact resistant to prevent damage to electronic devices retained therein;

a first electrically conductive end cap disposed about the periphery of the first end of the housing and coupled thereto and a second electrically conductive end cap disposed about the periphery of the second end of the housing and coupled thereto, the end caps configured to enhance grasping of the device by the user;

a resistor retained in the housing for controlling current flow through the device, the resistor having a first terminal coupled to the first end cap and a second terminal;

electrostatic voltage discharge indicating means for providing visual indication that a charge of electrostatic voltage accumulated in the body of the user has been discharged by the device, the indicating means having a first terminal coupled to the resistor and a second terminal coupled to the second end cap of the housing; and a translucent, non-electrically conductive, pliant, material disposed in the housing to prevent the end caps, resistor, and voltage discharge indicating means from inadvertently short circuiting and contacting an inner surface of the housing while providing viewing of electrostatic voltage discharged by the indicating means, wherein the user grasps a desired one of the end caps and with the remaining end cap abuts an electrically conductive object to ground the device, electrostatic charge accumulated in the user being dissipated through the device, with the resistor controlling current flow from the user through the device to prevent the user from receiving an electrical shock.

7. The device of claim 6 wherein the housing comprises a flexible translucent polymer.

8. The device of claim 7 wherein the housing has a length ranging from approximately 3.5 to approximately 7 centimeters and has a diameter ranging from approximately 0.5 to approximately 1.5 centimeters.

9. The device of claim 6 wherein the housing and end caps have an annular cross-sectional configuration.

10. The device of claim 6 wherein the electrostatic voltage discharge indicating means comprises a desired one of a neon gas glow tube and an argon gas glow tube.

11. The device of claim 6 wherein the resistor has a resistance value selected to provide sufficient resistance to current flowing through the device to prevent excessive current from flowing from the user to the device for inhibiting the user from receiving an electrical shock.

12. The device of claim 11 wherein the resistor has a resistance value ranging from approximately one megohm to approximately three megohm.

13. The device of claim 6 further comprising an annular member affixed to a desired one of the end caps for securing the device to a key ring.

* * * * *